US008399826B2

(12) United States Patent
Hager et al.

(10) Patent No.: US 8,399,826 B2
(45) Date of Patent: Mar. 19, 2013

(54) METHOD OF PROCESSING IONS

(75) Inventors: James W. Hager, Mississauga (CA); Yves Le Blanc, Newmarket, CA (US)

(73) Assignee: DH Technologies Development Pte. Ltd., Singapore (SG)

( * ) Notice: Subject to any disclaimer, the term of this patent is extended or adjusted under 35 U.S.C. 154(b) by 157 days.

(21) Appl. No.: 12/971,008

(22) Filed: Dec. 17, 2010

(65) Prior Publication Data

US 2011/0204218 A1 Aug. 25, 2011

Related U.S. Application Data

(60) Provisional application No. 61/288,045, filed on Dec. 18, 2009.

(51) Int. Cl.
*H01J 49/36* (2006.01)

(52) U.S. Cl. ..... 250/282

(58) Field of Classification Search ..... 250/281–300
See application file for complete search history.

(56) References Cited

U.S. PATENT DOCUMENTS

| | | | | |
|---|---|---|---|---|
| 5,747,801 | A * | 5/1998 | Quarmby et al. | 250/292 |
| 7,737,396 | B2 * | 6/2010 | Chernushevich et al. | 250/287 |
| 7,932,487 | B2 * | 4/2011 | Kovtoun et al. | 250/282 |
| 2009/0236514 | A1 * | 9/2009 | Renner | 250/282 |

* cited by examiner

*Primary Examiner* — Jack Berman
*Assistant Examiner* — Eliza Osenbaugh-Stewart

(57) ABSTRACT

A method for obtaining fragment ions having product ion spectrum with a mixture of high, medium and lower energy product ions. The method includes (a) providing a selected RF field to an ion optical element upstream of an ion containment field; (b) transmitting ions through the ion optical element and into the ion containment field such that the selected RF field determines, at least in part, a selected kinetic energy profile of the ions within the ion containment field, wherein the selected kinetic energy profile is selected to fragment the ions to concurrently provide a plurality of groups of product ions; and (c) detecting each group of product ions in the plurality of groups of product ions.

18 Claims, 9 Drawing Sheets

Epinephrine (precursor 184)
Conventional CID (Coll.Cell)
Normalize Intensity
Frag 77
Frag 107
Frag 135
Frag 151
Frag 166
Prec 184
420
CE (eV)

In-Trap Fragmentation (single Freq.Excitation)
430
Excitation Energy (mV)

Frag. via RF on IQ2 (200kHz)
440
RF Amplitude (V p-to-p)

Clenbuterol (precursor 277)

Frag. via RF onto IQ2 (200kHz)

METHOD OF PROCESSING IONS

CROSS-REFERENCE TO A RELATED SPECIFICATION

This application claims priority from U.S. Provisional Patent Application No. 61/288,045 filed Dec. 18, 2009, which is hereby incorporated in its entirety by reference.

FIELD

The embodiments described herein relate to methods of processing ions and mass spectrometers incorporating an ion containment device and more specifically to the processing of ions within such mass spectrometers.

INTRODUCTION

Mass spectrometers are often used to analyze the molecular and elemental composition of a sample. The sample is often ionized prior to being mass analyzed. The ions may be declustered prior to mass analysis. In addition, the ions may be fragmented.

SUMMARY

The following summary is intended to introduce the reader to this specification but not to define any invention. One or more inventions may reside in a combination or sub-combination of the apparatus elements or method steps described below or in other parts of this document. The inventors do not waive or disclaim their rights to any invention or inventions disclosed in this specification merely by not describing such other invention or inventions in the claims.

Some embodiments relate to a method of fragmenting ions, the method comprising: a) providing a selected RF field to an ion optical element upstream of an ion containment field; b) transmitting ions through the ion optical element and into the ion containment field such that the selected RF field determines, at least in part, a selected kinetic energy profile of the ions within the ion containment field, wherein the selected kinetic energy profile is selected to fragment the ions to concurrently provide a plurality of groups of product ions; and, c) detecting each group of product ions in the plurality of groups of product ions.

In some embodiments, the selected kinetic energy profile comprises a plurality of kinetic energy levels for the ions including a highest
kinetic energy level and a lowest kinetic energy level, the highest kinetic energy level being at least three times the lowest kinetic energy level; and, each group of product ions in the plurality of groups of product ions comprises only ions of the same mass to charge ratio and is generated by a precursor kinetic energy level in the plurality of kinetic energy levels.

In various embodiments, the plurality of kinetic energy levels comprises at least three kinetic energy levels, and the plurality of groups of product ions includes at least four groups of product ions. In some embodiments, each group of ions comprise fewer than half the ions in the plurality of groups of ions detected in c). In some embodiments, the highest kinetic energy level exceeds 50 eV. In some embodiments, the highest kinetic energy level exceeds 100 eV.

In some embodiments, the method further comprises after c), selecting a second selected RF field, then transmitting the ions through the ion optical element and into the ion containment field such that the second selected RF field determines, at least in part, a second selected kinetic energy profile of the ions within the ion containment field; fragmenting the ions to concurrently provide a second plurality of groups of product ions; and, detecting each group of product ions in the second plurality of groups of product ions; wherein the second selected RF field is different from the selected RF field, the second selected kinetic energy profile is different from the selected kinetic energy profile, and second plurality of groups of product ions is different from the plurality of groups of product ions.

In some embodiments, the ion optical element comprises an aperture lens. In some embodiments, the ion optical element comprises an element selected from the group consisting of: an interquad lens, a two wire element mounted transverse to the ion flow, a conical orifice, a skimmer plate, and a flat plate orifice.

In some embodiments, the method further comprises providing a force to at least a portion of ions upstream of the ion optical element wherein the force is substantially directed towards the ion optical element.

In some embodiments, the method further comprises providing a force to at least a portion of ions upstream of the ion optical element wherein the force is substantially directed away from the ion optical element.

In some embodiments, the selected kinetic energy profile comprises a continuous band of kinetic energies.

In various embodiments, the method further comprises: providing an ion source for producing the ions from neutrals; and providing a continuous path for the ions between the ion source and the ion containment field.

In some embodiments, the ion optical element is an aperture lens. In some embodiments, the ion optical element is an interquad lens. In some embodiments, the ion optical element is an ion optical lens having a skimmer-type lens geometry. In some embodiments, the ion optical element is a flat plate orifice. In some embodiments, the ion optical element is a conical orifice. In some embodiments, the ion optical element is a wire grid, such as for example but not limited to a mesh. In some embodiments, the ion optical element is a two-wire element mounted transverse to the ion flow.

In some embodiments, the ion optical element comprises a plate with a hole. In some embodiments, the ion optical element is an aperture lens. In some embodiments, the ion optical element is an orifice plate. In some embodiments, the ion optical element is a skimmer. In some embodiments, the ion optical element is an interquad lens. In some embodiments, the ion optical element is an ion optical lens having a skimmer-type lens geometry. In some embodiments, the ion optical element is a conical orifice. In some embodiments, the ion optical element is a wire grid (i.e. a mesh). In some embodiments, the ion optical element is a two-wire element mounted transverse to the ion flow.

Some embodiments relate to a method of declustering ions, the method comprising: a) providing a selected RF field to an ion optical element upstream of an ion containment field; and b) transmitting analyte ions and solvent ions through the ion optical element and into the ion containment field, wherein the solvent ions are non-covalently bonded to the analyte ions, such that the selected RF field determines, at least in part, a selected kinetic energy profile of the analyte ions and the solvent ions within the ion containment field; wherein the selected kinetic energy profile is selected to decluster most of the analyte ions and the solvent ions by breaking non-covalent bonds between the analyte ions and the solvent ions without breaking covalent bonds within most of the analyte ions to fragment the analyte ions.

In some embodiments, the ion optical element comprises an element selected from the group consisting of: an interquad lens, a two wire element mounted transverse to the ion flow, a conical orifice, a skimmer plate, and a flat plate orifice.

In some embodiments, a DC voltage is applied to the ion optical element. Thus, in some embodiments both a DC voltage and an RF field are applied to the ion optical elements. In some embodiments, no DC voltage is applied to the ion optical element.

In some embodiments, the ion optical element is an aperture lens. In some embodiments, the ion optical element is an interquad lens. In some embodiments, the ion optical element is an ion optical lens having a skimmer-type lens geometry. In some embodiments, the ion optical element is a flat plate orifice. In some embodiments, the ion optical element is a conical orifice. In some embodiments, the ion optical element is a wire grid, such as for example but not limited to a mesh. In some embodiments, the ion optical element is a two-wire element mounted transverse to the ion flow.

In some embodiments, the ion optical element comprises a plate with a hole. In some embodiments, the ion optical element is an aperture lens. In some embodiments, the ion optical element is an orifice plate. In some embodiments, the ion optical element is a skimmer. In some embodiments, the ion optical element is an interquad lens. In some embodiments, the ion optical element is an ion optical lens having a skimmer-type lens geometry. In some embodiments, the ion optical element is a conical orifice. In some embodiments, the ion optical element is a wire grid (i.e. a mesh). In some embodiments, the ion optical element is a two-wire element mounted transverse to the ion flow.

In some embodiments, the amplitude and frequency are selected to cause declustering without substantially causing fragmentation of analyte ions, so that an intensity of cluster ions is reduced. In some embodiments, the amplitude and frequency are selected to cause fragmentation of analyte ions.

Some embodiments relate to a method of encoding frequency information into ions, the method comprising: a) determining a first selected frequency; b) providing a first selected RF field of the selected frequency to an ion optical element upstream of an ion containment field; c) transmitting a first group of ions through the ion optical element and into the ion containment field such that a selected kinetic energy profile of the ions within the ion containment field has the selected frequency; d) measuring a frequency of ions within the ion containment field to determine if the frequency measured is the selected frequency.

In some embodiments, the method of encoding frequency information into ions as defined in claim 1 further comprises: a) determining a second selected frequency; b) providing a second selected RF field of the second selected frequency upstream of the ion containment field; c) transmitting a second group of ions through the second selected RF field and into the ion containment field such that the first group of ions and second group of ions are contained together within the ion containment field, and the second group of ions within the ion containment field has a second selected kinetic energy profile of the second selected frequency; d) measuring a frequency of a kinetic energy profile of each ion in a plurality of ions within the ion containment field, to determine whether the frequency is the first frequency or the second frequency to determine whether each ion in the plurality of ions is in the first group or the second group of ions.

DRAWINGS

For a better understanding of the embodiments described herein and to show more clearly how they may be carried into effect, reference will now be made, by way of example only, to the accompanying drawings which show at least one example embodiment, and in which.

DESCRIPTION OF VARIOUS EMBODIMENTS

Figure 1:
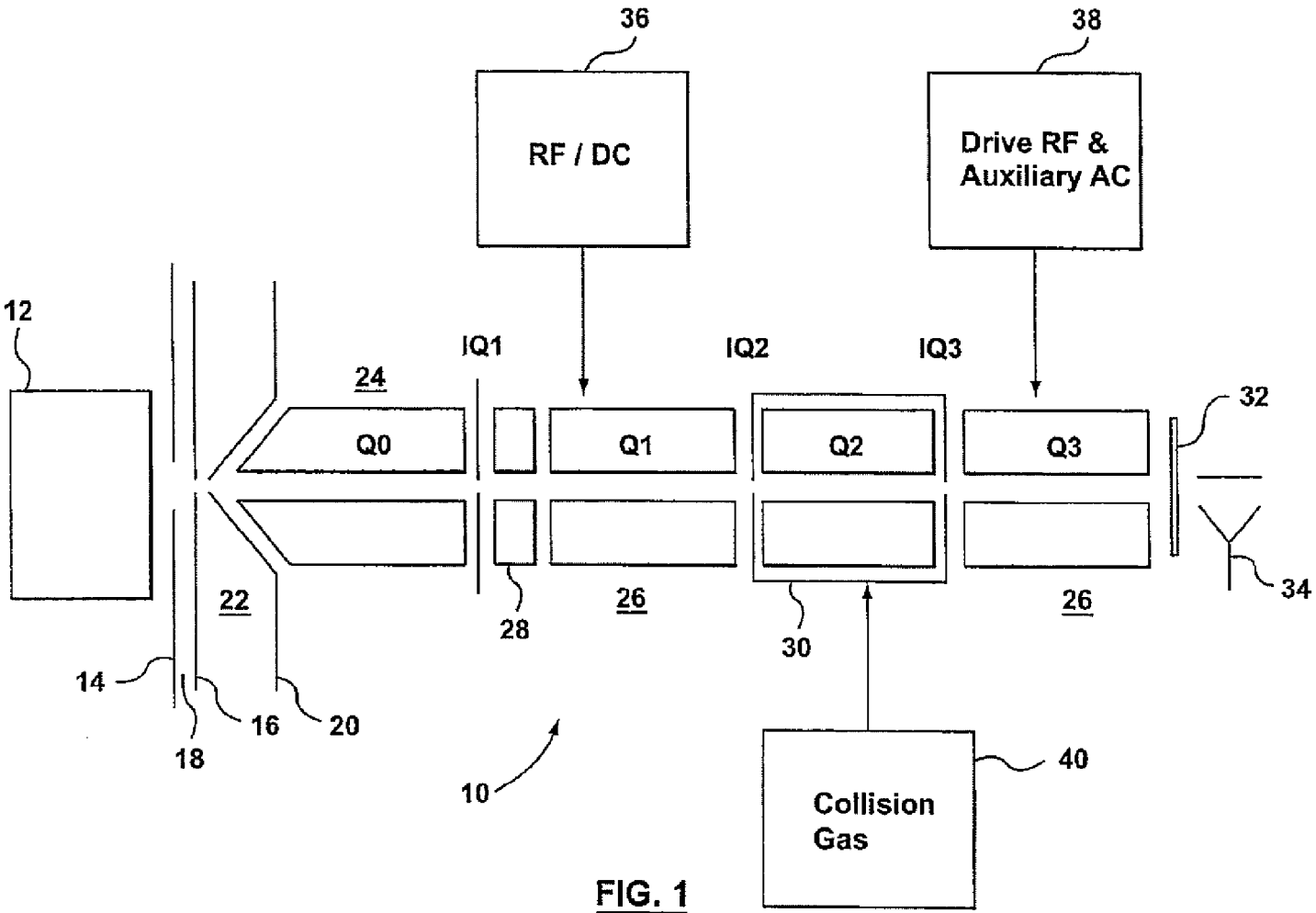
FIG. 1 Prior Art
FIG. 1 is a schematic view of a conventional QTRAP® hybrid quadrupole-linear ion trap mass spectrometer.
Figure 2:
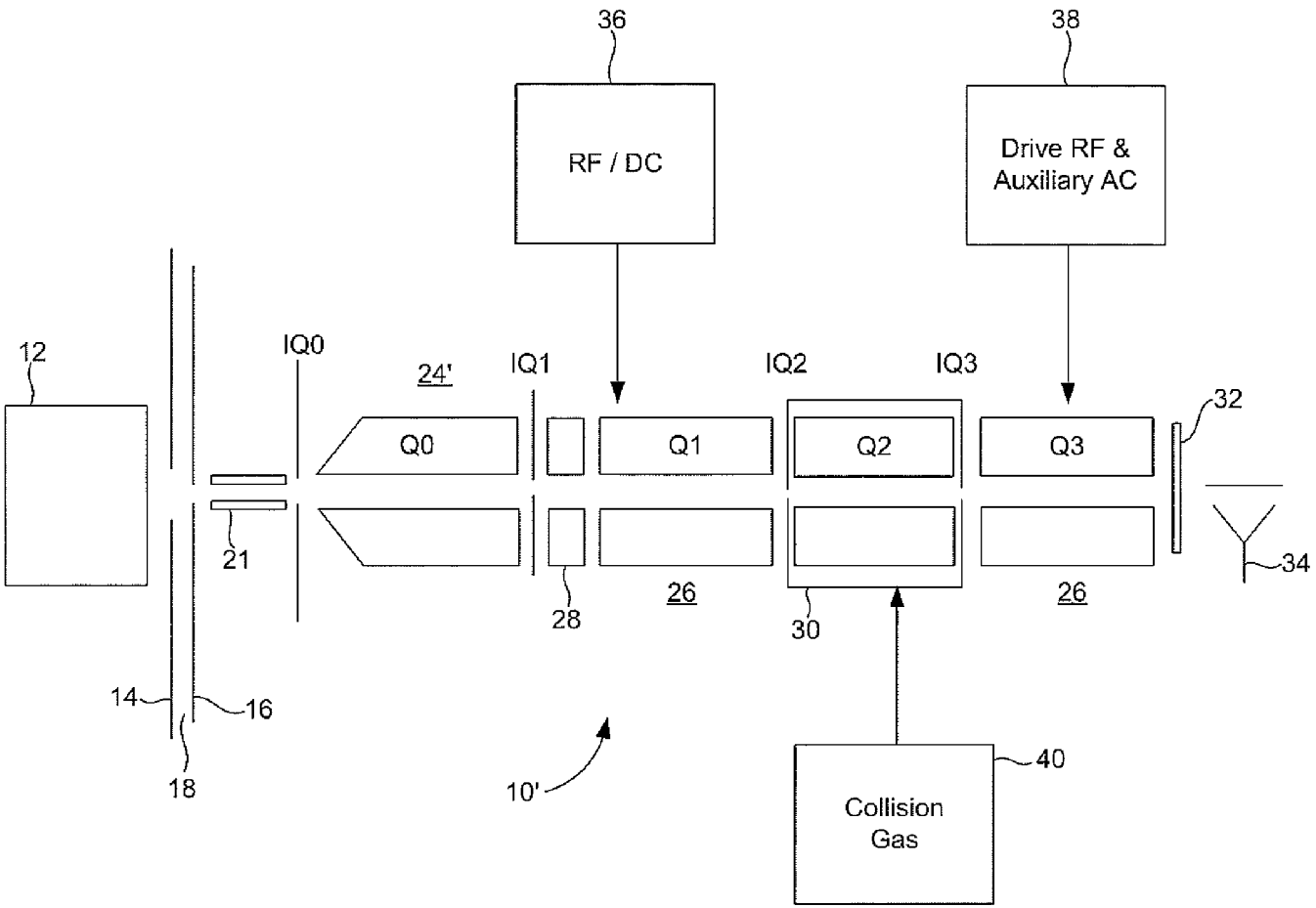
FIG. 2 Prior Art
FIG. 2 is a schematic view of an alternative conventional QTRAP® hybrid quadrupole-linear ion trap mass spectrometer.

Referring first to FIGS. 1 and 2, there are shown two conventional triple quadruple mass spectrometer apparatus generally designated by references 10 and 10' respectively. The two embodiments are similar and will be described together except for the parts that differ between embodiments, which will be separately described. An ion source 12, for example an electrospray ion source, generates ions directed towards a curtain plate 14. Behind the curtain plate 14, there is an orifice plate 16, defining an orifice, in known manner.

A curtain chamber 18 is formed between the curtain plate 14 and the orifice plate 16, and a flow of curtain gas reduces the flow of unwanted neutrals into the analyzing sections of the mass spectrometer. The two embodiments illustrated in FIGS. 1 and 2 differ in their structure between the orifice plate and the interquad barrier IQ1 and these portions of the mass spectrometers will be discussed separately for each embodiment.

In mass spectrometer 10 of FIG. 1, following the orifice plate 16, there is a skimmer plate 20. An intermediate pressure chamber 22 is defined between the orifice plate 16 and the skimmer plate 20. The pressure in chamber 22 is typically of the order of 2 Torr. Ions pass through the skimmer plate 20 into the first chamber of the mass spectrometer, indicated at 24. A quadruple rod set Q0 is provided in this chamber 24, for collecting and focusing ions. This chamber 24 serves to extract further remains of the solvent from the ion stream, and typically operates under a pressure of 7 mTorr. It provides an interface into the analyzing sections of the mass spectrometer.

Referring now to FIG. 2, in mass spectrometer 10', following the orifice plate 16 there is an ion guide 21. The ion guide 21 focuses the ions passing through it. In some embodiments, ion guide 21 has a length of approximately 55 mm and a diameter of approximately 4 mm. In addition, in various embodiments, an AC voltage with a frequency of approximately 1.1 MHz and an amplitude in the range of 0-300 V is applied to ion guide 21. An interquad lens IQ0 separates the ion guide 21 and chamber 24'. Ions pass through the interquad lens IQ0 into the first chamber of the mass spectrometer, indicated at 24'. A quadruple rod set Q0' is provided in this chamber 24', for collecting and focusing ions. This chamber 24' serves to extract further remains of the solvent from the ion stream, and typically operates under a pressure of 7 mTorr. It provides an interface into the analyzing sections of the mass spectrometer.

In some embodiments of mass spectrometer 10', Quadruple rod set Q0' and chamber 24' are shorter than quadruple rod set Q0 and chamber 24 respectively of mass spectrometer 10. In particular, as mentioned above, one function of Q0 and Q0' is to collect and focus the ions. However, the ion guide 21 also serves to collect and focus the ions prior to their entry into Q0'.

Referring now to both FIGS. 1 and 2, an interquad barrier or lens IQ1 separates the chambers 24 and 24' respectively from the main mass spectrometer chamber 26 and has an aperture for ions. Adjacent the interquad lens IQ1, there is a short "stubbies" rod set, or Brubaker lens 28. A first mass resolving quadruple rod set Q1 is provided in the chamber 26 for mass selection of a precursor ion. Following the rod set Q1, there is a collision cell 30 containing a second quadruple rod set Q2, and following the collision cell 30, there is a third quadruple rod set Q3 for effecting a second mass analysis step.

The final or third quadruple rod set Q3 is located in the main quadruple chamber 26 and subjected to the pressure therein typically 1×10-5 Torr. As indicated, the second quadruple rod set Q2 is contained within an enclosure forming the collision cell 30, so that it can be maintained at a higher pressure; in known manner, this pressure is analyte dependent and could be 5 mTorr. Interquad lenses IQ2 and IQ3 are provided at either end of the enclosure of the collision cell of 30.

Ions leaving Q3 pass through an exit lens 32 to a detector 34. It will be understood by those skilled in the art that the representation of FIGS. 1 and 2 are schematic, and in various embodiments various additional elements would be provided to complete the apparatus. For example, in various embodiments, a variety of power supplies are utilized to deliver AC and DC voltages to different elements of the apparatus. In addition, in some embodiments a pumping arrangement or scheme is utilized to maintain the pressures at the desired levels mentioned.

As indicated, a power supply 36 is provided for supplying RF and DC resolving voltages to the first quadruple rod set Q1. Similarly, a second power supply 38 is provided for supplying drive RF and auxiliary AC voltages to the third quadruple rod set Q3, for scanning ions axially out of the rod set Q3. A collision gas is supplied, as indicated at 40, to the collision cell 30, for maintaining the desired pressure therein, and an RF supply would also be connected to Q2 within the collision cell 30. As will be explained in greater detail below, AC and/or DC voltages may be applied to various ion optical elements such as the interquad lenses.

Although two specific embodiments of mass spectrometers have been discussed above, it should be understood that various embodiments of the methods of processing ions described herein can be applied to any appropriate mass spectrometer including but not limited to a quadrupole, such as ion traps or time-of-flight mass spectrometers. In addition other ion containment devices, such as hexapoles, octupoles, and ring guides, may be used. In particular, various embodiments of the methods described herein can be applied to any appropriate arrangement that contains the ions radially and operates at an elevated pressure.

In various embodiments, the methods of processing ions described herein can be applied to various applications including, but not limited to, declustering and fragmenting ions. Declustering can also be referred to as desolvating and is the process by which analyte ions are separated from other particles in the gas phase, such as solvent particles or buffer particles, where buffers can consist of acids or bases or salts that are added to the solvent. Specifically, the analyte may be in a solution prior to being mass analyzed and as discussed above, in such cases, it may be necessary to remove residual solvent molecules or other neutrals from the ions prior to analyzing them. In contrast, fragmentation involves breaking analyte ions into their constituent parts. Thus, a major difference between fragmentation and declustering is the amount of kinetic energy required to break apart the bonds of the particles. For the same type of analyte, fragmentation usually requires a greater amount of energy than declustering given that fragmentation generally involves breaking apart molecules that are made of atoms that are covalently bonded while declustering generally involves breaking apart species that are not covalently bonded. Declustering generally results in reducing the intensity of cluster ion peaks in the mass spectrum. Cluster ions can consist of solvent ions or buffer ions clustered with solvent or buffer molecules, or of analyte ions clustered with solvent or buffer molecules.

In various embodiments, the method includes the step of determining or selecting a kinetic energy profile for the ions within an ion containment field. As will be explained below, this is not necessarily the first step and in some embodiments, the kinetic energy is selected indirectly. The kinetic energy profile refers to the distribution of kinetic energies of the ions that are within the ion containment field. In various embodiments, the selected kinetic energy profile is selected to fragment the ions to concurrently provide a plurality of groups of product ions.

In various embodiments, the kinetic energy profile is a continuous function. In addition, in some embodiments, the kinetic energy profile is a continuous function that includes a wide band of kinetic energies. This is in contrast to known methods in which a discrete kinetic energy value is used to fragment ions. In some embodiments of the method of fragmenting ions, the highest kinetic energy level in the kinetic energy profile is at least three times the lowest kinetic energy in the kinetic energy profile. In some embodiments of the method of fragmenting ions, the highest kinetic energy level exceeds 50 eV. In various embodiments, the highest kinetic energy level exceeds 100 eV.

In various embodiments of the method of processing ions where the method is applied to fragmentation, the kinetic energy profile can be selected such that a desired fragmentation spectrum is achieved when the ions are fragmented. In various embodiments, the ions are fragmented in a collision cell such as collision cell 30. Accordingly, in some such embodiments, the ion containment field within which the ions are processed or fragmented is the ion containment field produced by Q2. The particular kinetic energy profile that is selected can be determined based on a variety of factors including but not limited to the particular type of ions that are to be fragmented and the desired fragmentation spectrum. The term "fragmentation spectrum" as used herein refers to the spectrum of ions produced from fragmenting the analyte precursor ions.

In some embodiments, the method further includes the step of determining at least one characteristic of a RF field based on the kinetic energy profile that has been selected. The at least one characteristic can include, but is not limited to, the amplitude and frequency of the RF field. As will be explained in greater detail below, the RF field determines, at least in part, the kinetic energy profile that is achieved.

In various embodiments, the selected RF field is applied to an ion optical element that is upstream of the ion containment field. Prior to entering the ion containment field, the ions pass through an ion optical element and interact with the RF field that is applied to the ion optical element. The ion optical element can be any appropriate ion optical element. Thus, for example, the ion optical element can be but is not limited to, any appropriate aperture lens, such as an interquad lens, an ion optical lens having a skimmer-type lens geometry, a flat plate orifice, a conical orifice, a wire grid (i.e. a mesh), or a two-wire element mounted transverse to the ion flow. Thus, for example, in various embodiments where the ion containment field is that of Q2 and the ion optical element is an interquad lens, the selected RF field can be applied to IQ2, IQ1, or IQ0.

In some embodiments, in addition to the RF field, a DC offset voltage is also applied to the ion optical element. The kinetic energy profile of the beam of ions transmitted through the ion optical element is determined primarily by the RF and DC voltages applied to the element. In certain instances it is desirable to add attractive or repulsive DC voltages to the ion optical element to control the resulting kinetic energy profile of the transmitted ion beam. An attractive DC voltage will add an offset energy to the ions transmitted through the ion optical element. A repulsive DC voltage will reduce the average ion energy of the ions transmitted through the ion optical element and, in some embodiments, may cause some ions not to be transmitted at all.

In general, the ion optical element can be any appropriate ion optical element, including but not limited to any of the ion optical elements described above. However, in some embodiments, only ion optical elements that are not upstream of a mass analyzer are selected for application of the RF field. For example, in some embodiments, Q1 is operated as a mass analyzer. Accordingly, in some such embodiments, IQ1 is typically not used as the ion optical element to which the RF field is applied in the manner described herein. The reason for this is that it can be desirable to have a well-defined analyte ion energy entering a mass analyzer. Applying an RF field can cause the ion energy of the beam to change as discussed below. However, in some embodiments, Q1 is not operated as a mass analyzer and in some such embodiments the selected RF field is applied to IQ1 for example.

The beam of ions produced at source 12 is transmitted through the ion optical element to which the selected RF field has been applied and travels into the ion containment field. As the ions are transmitted through the ion optical element, they interact with the RF field that has been applied to the ion optical element. Specifically, the selected RF field affects the kinetic energy of the ions that are transmitted through the ion optical element and move into the ion containment field. Accordingly, the selected RF field determines, at least in part, the kinetic energy profile of the ions within the ion containment field.

In various embodiments, the ions are processed in the ion containment field by introducing a neutral gas stream into the ion containment field. This can be done as described above with respect to collision cell 30 and collision gas 40. The ions collide with the neutral gas stream in the ion containment field with collision energies that are determined by their kinetic energy profile. Depending on the selected kinetic energy profile and the type of ions, these collisions can be used to fragment or decluster the ions.

As mentioned above, in various embodiments, the selected kinetic energy profile is selected to fragment the ions to concurrently provide a plurality of groups of product ions. For example, in some embodiments, the kinetic energy profile is selected to produce a given number of groups of product ions. In some embodiments the kinetic energy profile is selected so that there are three energy levels in the kinetic energy profile that cause three separate groups of fragment ions to be formed. Each of these three energy levels can be referred to as precursor kinetic energy levels. In various embodiments, the kinetic energy profile is selected such that the product ions include at least four groups, where there are at least three groups of fragment ions and a group of precursor ions. It should be understood that this is an example only and is not intended to be limiting. For example, some embodiments have greater than three groups of fragment ions.

In various embodiments, each of the groups of product ions comprise only ions of the same mass to charge ratio. In other words, in various embodiments, each group of product ions refers to a particular generation of fragment ions or to precursor ions. In addition, in some embodiments, each of these groups of product ions comprise less than half of the total ions that are produced in the ion containment field.

Although some embodiments of the method have been described as comprising the step of determining a selected kinetic energy profile for the ions and then selecting a RF field based on the selected kinetic energy profile, in some embodiments, it is generally the case that this is not done in a series of independent discrete steps but rather is done in an iterative manner. Specifically, in some embodiments a RF field can be selected and applied to the ion optical element and the resulting fragmentation can be observed. From the resulting fragmentation, one can deduce the kinetic energy profile of the ions prior to fragmentation. Based on the observed level of fragmentation, the RF field can be adjusted until a desired fragmentation spectrum is achieved. The term "fragmentation spectrum" as used herein refers to the spectrum of ions produced from fragmenting the analyte precursor ions.

In other words, a second RF field can be selected and applied to the ion optical element. The ions can then be transmitted through the ion optical element and into the RF containment field where, in some embodiments, the ions are fragmented and a second plurality of groups of product ions are produced concurrently. In various embodiments, the second plurality of groups of product ions can be different than the first. In some embodiments, the second plurality of groups can include all of the first plurality of groups or vice-versa. Accordingly, in some embodiments, the second plurality of groups may include a greater or lesser number of generations of fragment ions. In some embodiments, the second plurality of groups of ions and the first plurality groups of ions are non-overlapping. In various embodiments, the product ions can be detected by detector 34.

Alternatively, a RF field can be selected based on the ions that are being processed. For example, in some embodiments, it may be known that a given RF field will produce a given fragmentation spectrum and this RF field can be selected.

Similarly, for the method of declustering an RF field can be selected and applied to an ion optical element. The analyte ions, which are non-covalently bonded, are transmitted through the ion optical element and into the ion containment field. The RF field determiners, at least in part, the kinetic energy profile of the analyte ions. In various embodiments, the ions are declustured in the ion containment field. The RF field is selected such that when declustering the analyte ions and solvent ions the non-covalent bonds between most of the analyte ions and the solvent ions are broken without breaking most of the covalent bonds of the analyte, ions themselves. In other words, in various embodiments the RF field is selected such that the declustering occurs without any significant fragmentation of the analyte ions occurring.

The kinetic energy profile of the analyte ions can be adjusted and affected in various ways. For example, various characteristics of the RF field applied to the ion optical element can be altered, including, but not limited to, the amplitude of the RF field and the frequency of the RF field. In addition, if a DC voltage is also applied then the DC voltage can also be adjusted to affect the kinetic energy profile. Altering one or more of the above-listed variables can, for example, adjust such things as the average energy in the kinetic energy profile and the range of kinetic energies in the kinetic energy profile.

Figures 3A, 3B, 3C:
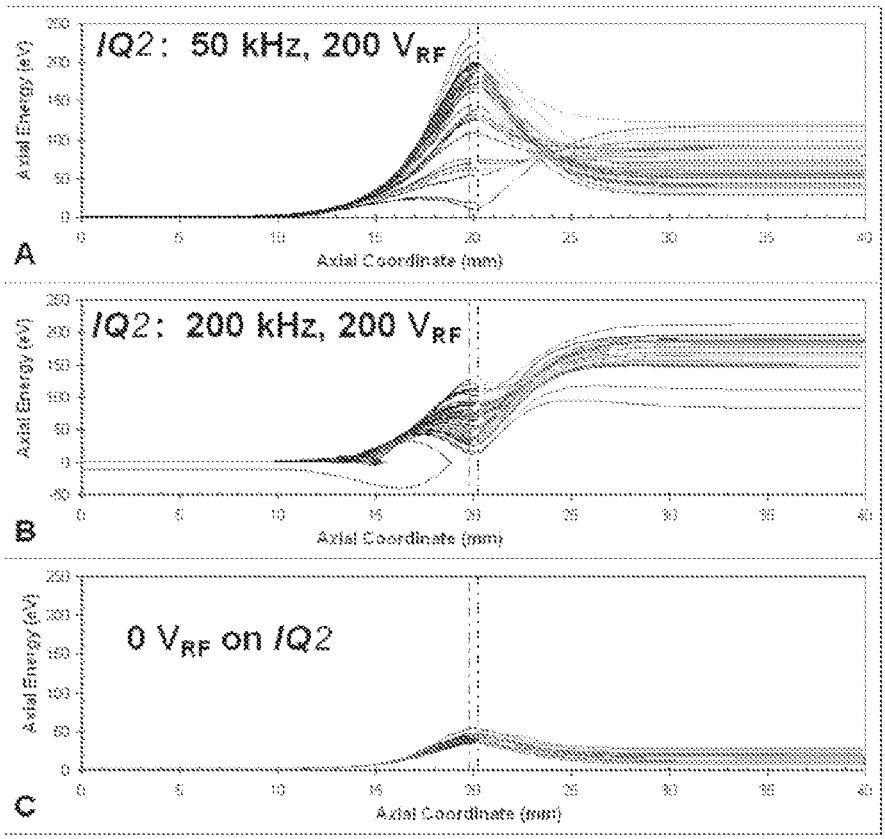
FIGS. 3A to 3C are graphs illustrating axial energy of ions before and after passing through an ion optical element operated in accordance with Applicants' teachings.

Reference is now made to FIG. 3A to 3C, which illustrate axial energy as a function of axial position for different RF fields applied to the ion optical element using computer simulations for 50 ions. The ion optical element in this case is an interquad lens IQ2. The dot-dash vertical lines delimit the axial range of IQ2. In each of the three figures the lens is positioned at 20 mm. With one exception, all the ions pass through the lens. The single exception occurs in FIG. 3B where one of the ions is reflected from IQ2. In FIG. 3A, the RF field applied to the lens has a frequency of 50 kHz and an amplitude of 200 Vpp. In FIG. 3B, the RF field applied to the lens has a frequency of 200 kHz and an amplitude of 200 Vpp. In FIG. 3C, no RF field is applied to the lens. In addition, in each of FIGS. 3A to 3C, an attractive 40 V DC offset is applied to the lens.

As can be seen from comparing the figures, the ions that are transmitted through the lens have a much higher average energy in the case of FIGS. 3A and 3B, than they do in the case of FIG. 3C. More specifically, looking at a distance of 5 mm in either direction from the lens, the axial energy of the ions is increased significantly after passing though the lens. In addition, these same ions have a greater or wider distribution of axial energy than the case where no RF field is applied to the lens. Specifically, in FIG. 3C, the ion axial energies are clustered together; while, in FIGS. 3A and 3B, the axial energies are spread out over a range of roughly 100 eV or more.

In various embodiments, the method described herein can produce a wide fragmentation spectrum with the precursor ion and a plurality of generations of fragments observed simultaneously. Part of the reason for this is, as described above, that the ions have a wide kinetic energy profile and therefore a wide range of collision energies can be achieved simultaneously. Furthermore, a rather large average kinetic energy can also be achieved and therefore the range of energies can be useful for fragmentation.

The RF field applied to the lens can be any appropriate voltage. In some embodiments, the voltage applied to the lens is in a range from 10 Vpp to 200 Vpp. In addition, any appropriate frequency can be used for the RF field. For example, in some embodiments, a frequency range of 1 kHz to 500 kHz is used. In some other embodiments, the range of frequencies used is 10 kHz to 200 kHz. These are example amplitude and frequency ranges only and are not intended to be limiting. Some other embodiments operate with RF fields having amplitudes and frequencies outside of these ranges. In various embodiments, an appropriate RF field can be selected based in part on the desired kinetic energy profile of the ions and one or more characteristics, such as the mass to charge ratio (m/z), of the particular ions being processed.

In some embodiments, the ion beam produced by ion source 12 is a continuous or uninterrupted beam of ions that extends from ion source 12, through the lens to which the RF field is applied, through the ion containment field (e.g. in the collision cell) and into the detector. In other words, in various embodiments, during operation, the beam is not interrupted between any of the above-mentioned sections of the mass spectrometer but rather there is a continuous path through each of those components starting from source 12 and extending to detector 34 and the beam of ions is simultaneously or concurrently present at each of those components of the mass spectrometer.

In various other embodiments, the ion beam produced by ion source 12 is a continuous or uninterrupted beam of ions that extends from ion source 12, through the lens to which the RF field is applied, an into the ion containment field (e.g. in the collision cell). In other words, in various embodiments, during operation, the beam is not interrupted between any of the above-mentioned sections of the mass spectrometer but rather there is a continuous path through each of those components starting from source 12 and extending to ion containment field and the beam of ions is simultaneously or concurrently present at each of those components of the mass spectrometer.

Figures 4A, 4B, 4C:
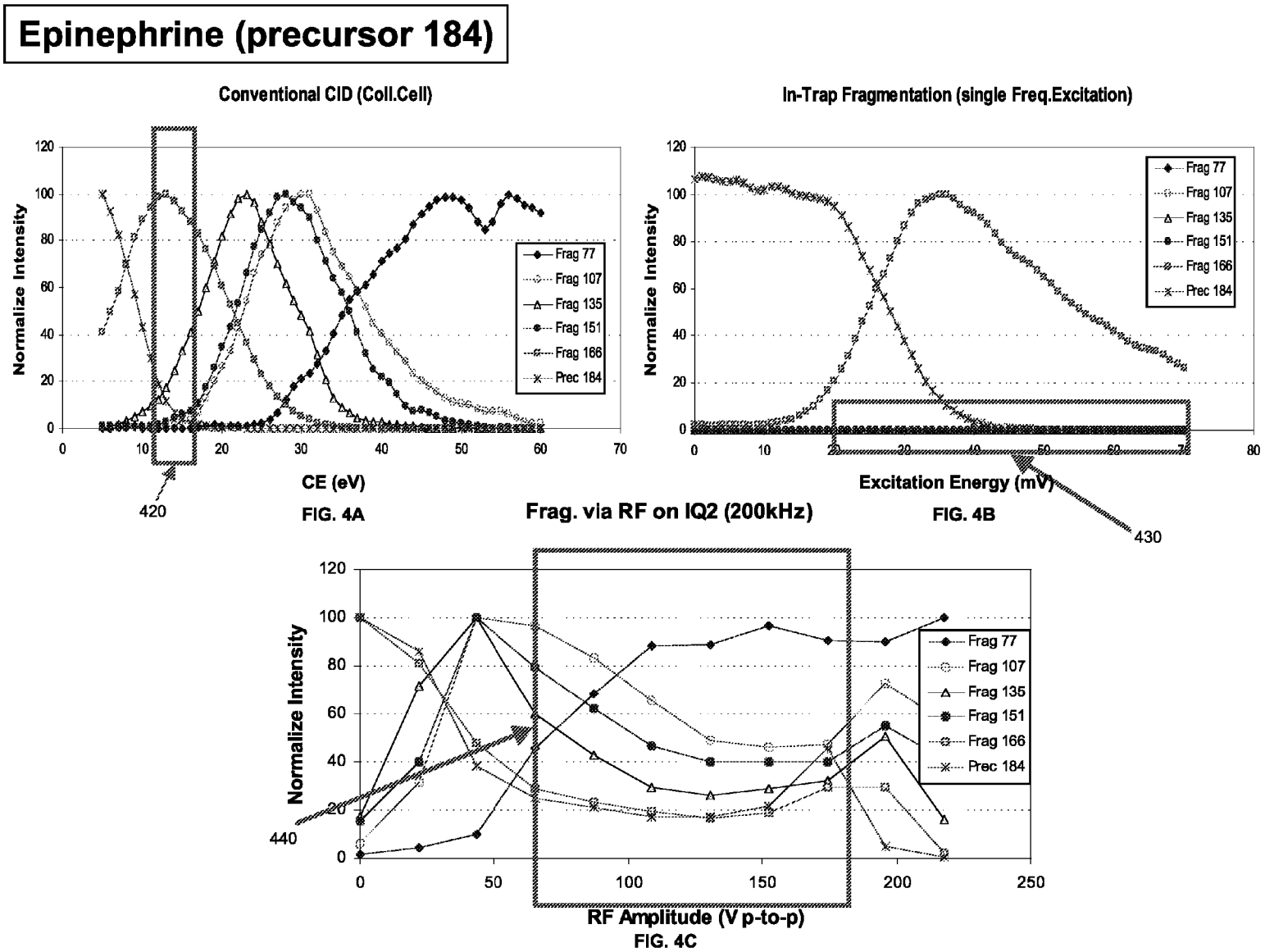
FIGS. 4A to 4C are graphs illustrating the normalized intensities of fragments for various methods of fragmenting epinephrine.

The following data was obtained using a 4000QTRAP instrument. The RF/DC quadrupole Q1 was used to select the m/z of the precursor ion. The selected precursor ions were passed through an aperture lens (IQ2) located in front of a quadrupole collision cell and finally into the Q3 linear ion trap. After an appropriate cooling time, the contents of the linear ion trap were scanned out using mass selective axial ejection toward the ion detector. Reference is now made to FIGS. 4A to 4C, which are graphs illustrating the normalized intensities of product ions for various methods of fragmentation for epinephrine. In FIGS. 4A and 4B no RF was applied to the IQ2 aperture lens. In FIG. 4C, a 200 kHz RF field was applied to IQ2. More specifically, FIG. 4A illustrates a graph of normalized intensity of product ions against collision energy in eV for the case where conventional beam type collision induced dissociation (CID) is used to fragment epinephrine prior to the final mass analysis step. As can be seen from the graph, there is only a narrow region 420 in which the precursor and the low mass fragments are simultaneously observable. As can be seen from the figure, region 420 is less than 5 eV wide. In addition, there is no region in the graph where the precursor and the lowest fragment can be observed simultaneously.

FIG. 4B illustrates a graph of normalized intensity of product ions versus excitation energy in mV for the case where in-trap fragmentation within the Q3 linear ion trap is used to fragment epinephrine. As can be seen from the figure, only 1 fragment is observed in the first fragmentation stage. All other fragments, indicated at 430, have a normalized intensity value of 0. In order to observe the remaining fragments multiple fragmentation stages (MSn) are required. Accordingly, as is the case with CID described in relation to FIG. 4A, it is not possible to view the precursor and low mass fragments in the same fragmentation stage.

FIG. 4C illustrates a graph illustrating the intensity of product ions that result from the application of embodiments of the method described herein. Specifically, FIG. 4C illustrates the normalized intensity of product ions versus the amplitude of the 200 kHz RF field applied to the ion optical lens. More specifically, the voltage indicated on the x-axis is the voltage that was applied to interquad lens IQ2. In FIG. 4C, the frequency is held constant at 200 kHz and the DC offset voltage that is applied to IQ2 is 46 V attractive.

Figure 5A:
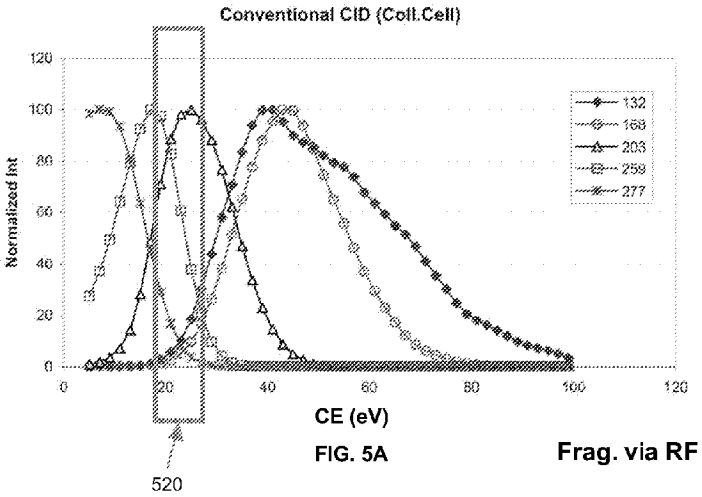
FIGS. 5A to 5C are graphs illustrating the normalized intensities of fragments for various methods of fragmenting clenbuterol.
Figure 5B:
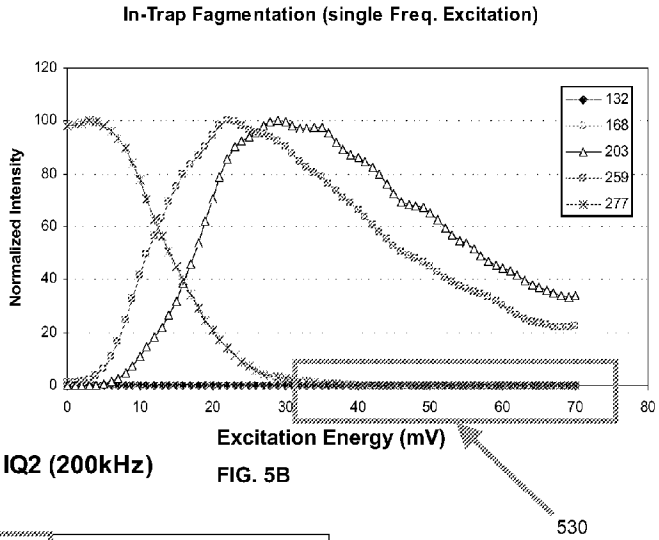
Figure 5C:
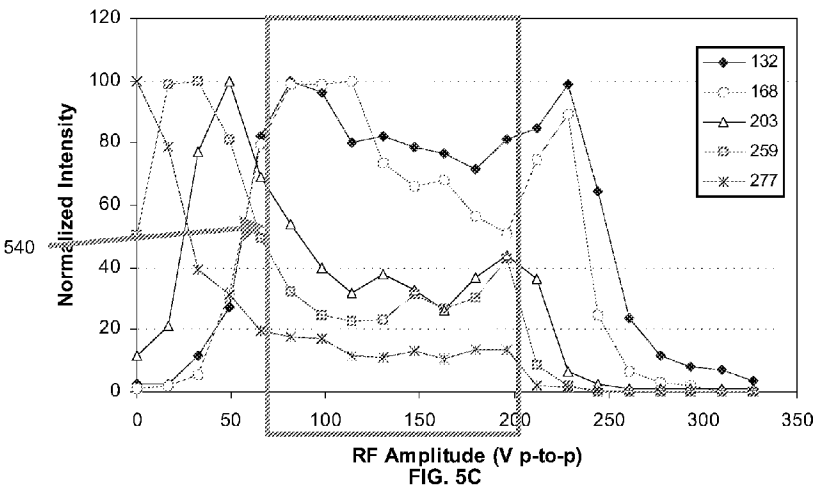
Figures 6A, 6B, 6C:
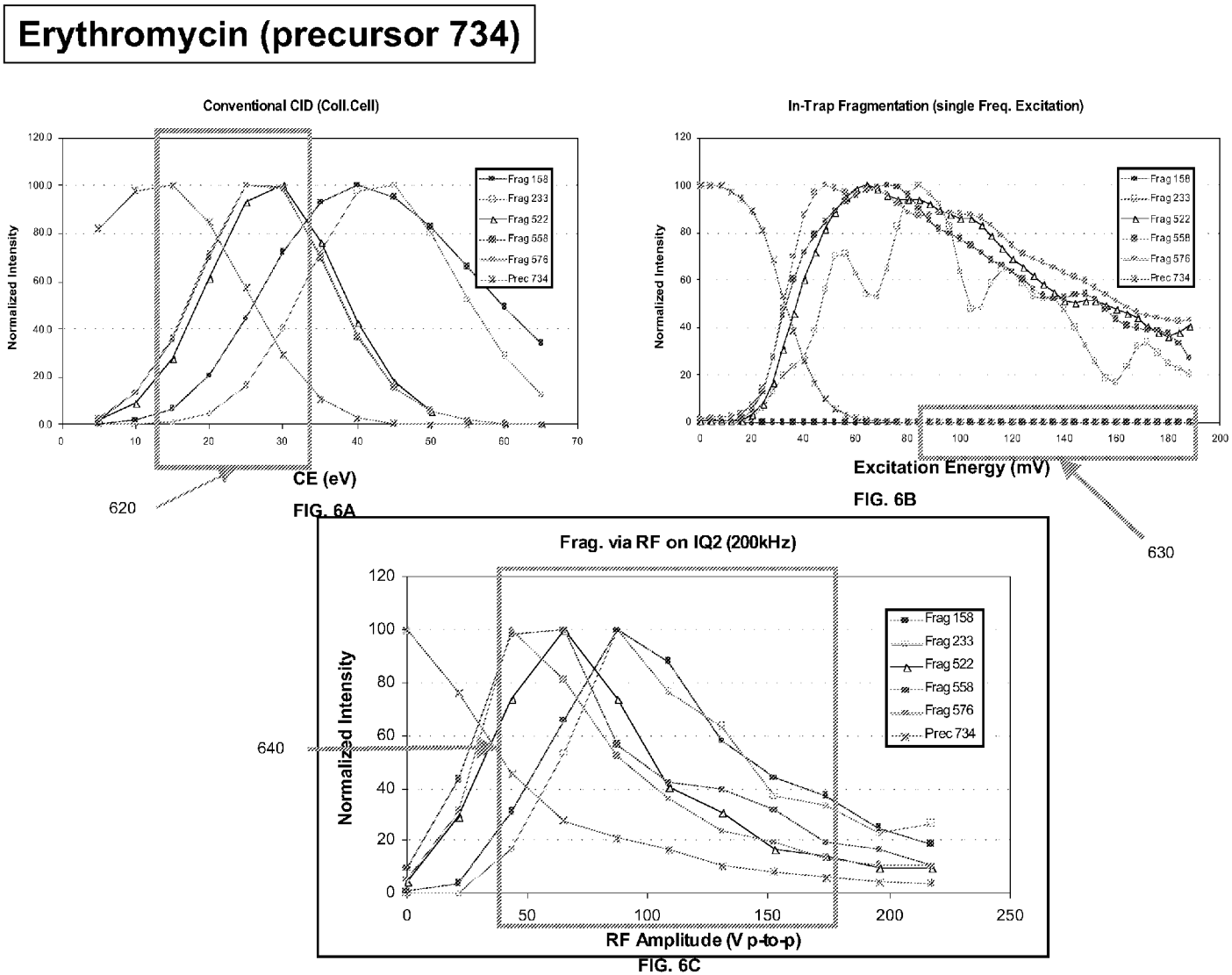
FIGS. 6A to 6C are graphs illustrating the normalized intensities of fragments for various methods of fragmenting erythromycin.

FIGS. 5A to 5C and 6A to 6C are analogous to FIGS. 4A to 4C except that they are for clenbuterol and erythromycin respectively. They illustrate results that are similar to those discussed in relation to FIGS. 4A to 4C. Specifically, FIGS. 5A and 6A illustrate that the use of conventional CID results in only narrow regions 520 and 620 of collision energies where precursor and low mass fragments are simultaneously observed for clenbuterol and erythromycin. As can be seen from the figures, region 520 is approximately 5 eV wide; while, region 620 is approximately 20 eV wide. FIG. 5B illustrates that when in-trap fragmentation within the Q3 linear ion trap is used to fragment clenbuterol, the low mass fragments, indicated at 530, are not observed in the first fragmentation stage and therefore multiple stages of fragmentation are required. Similarly, FIG. 6B, illustrates that when in-trap fragmentation is used to fragment erythromycin, the low mass fragments are never observed due to the low mass cut-off of the linear ion trap.

Finally, FIGS. 5C and 6C illustrate that when embodiments of the method described herein are applied to fragmenting clenbuterol and erythromycin respectively, then there are wide regions 530 and 630 respectively where precursor ions and low mass fragments are simultaneously observed.

As discussed above, in various embodiments, the methods described herein includes the steps of applying a RF field to an ion optical element and transmitting ions through the ion optical element and then into an ion containment field. The RF field applied to the ion optical element determines, at least in part, the kinetic energy of the ions within the containment field and therefore the RF field can be adjusted to achieve a particular kinetic energy profile. For example, various parameters of the RF field can be adjusted including but not limited to the amplitude and frequency to adjust such things as the average energy and the range of energies in the kinetic energy profile. In addition, the selected kinetic energy profile of the ions in the ion containment field can have an axial energy profile that is modulated at the frequency of the RF applied to the ion optical element. If the containment device is pressurized this modulation is sometimes lost due to the large number of collisions with the background gas molecules. The modulation of the axial kinetic energy can be observed in the absence of collisions.

Figure 7:
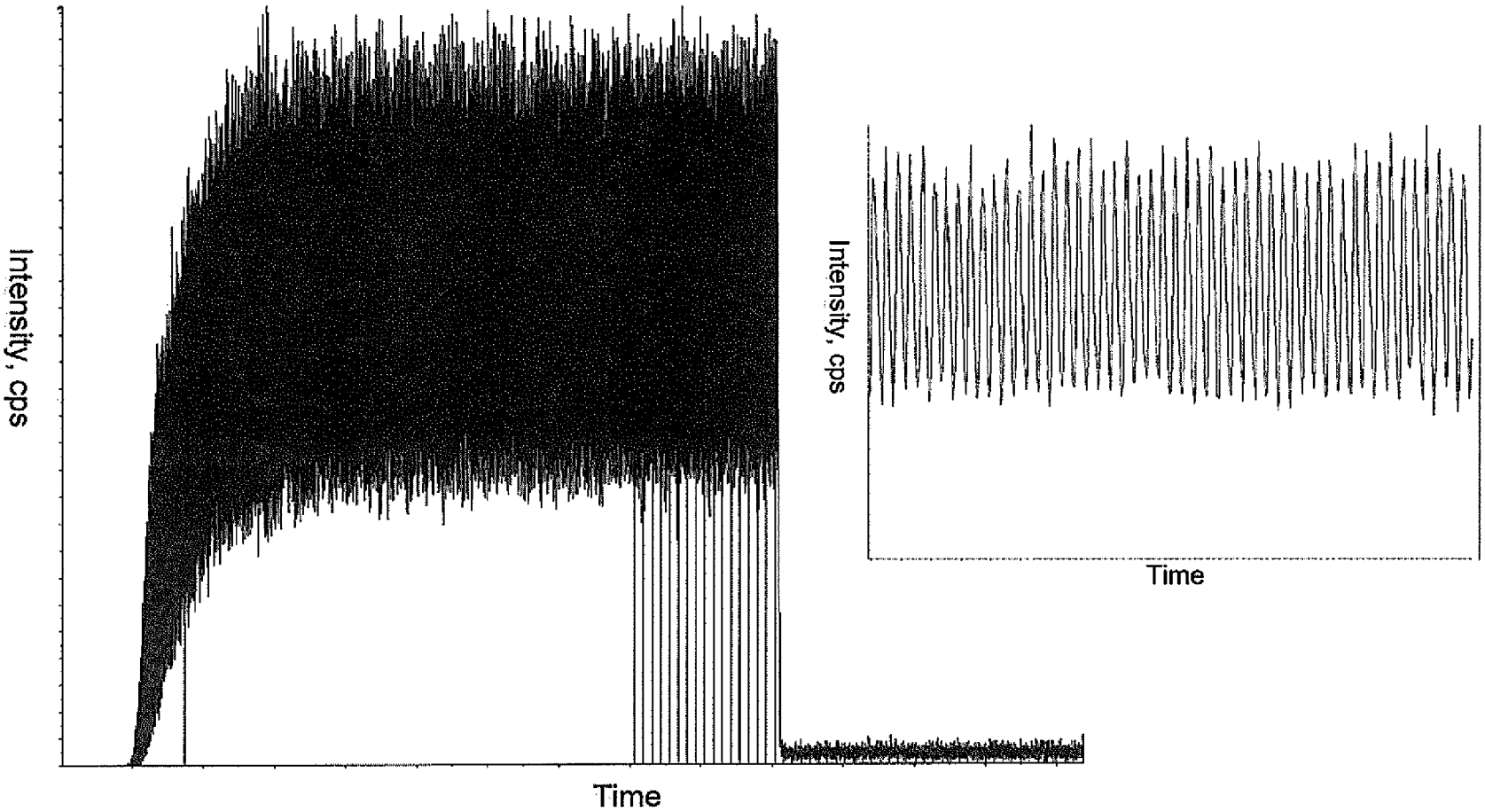
FIG. 7 is a graph illustrating the intensity of an ion beam after passing through exit lens 32.

Reference is now made to FIG. 7, which illustrates two graphs of intensity of the ion beam after passing through exit lens 32. Specifically, a RF field with a frequency of 50 kHz is applied to IQ2 between 2 ms and 20 ms. In addition, a repulsive 20 V DC voltage is applied to exit lens 32. The DC repulsive barrier discriminates based on the kinetic energy of the ions and allows only ions with kinetic energies that are above a threshold energy level to pass through exit lens 32. The ions are detected at detector 34, which can detect the energy level of the ions. The plot on the right is a blown up version of the intensity between 8 ms and 9 ms. As can be seen from FIG. 7, the intensity of the ion beam is a continuous function. The frequency of the intensity is 50 kHz which matches the frequency of the RF field applied to IQ2. Thus, the ions pick up energy as they pass through the lens and the amount of energy pickup follows the phase of the RF field applied to the IQ2 aperture lens. Accordingly, through the use of the method described herein, it is possible to encode the ion beam with frequency information of the RF field applied to the IQ2 aperture lens.

In various embodiments, the RF field applied to the ion optical element can be varied in any appropriate manner to encode any appropriate desired information in the ions. For example, although the use of a single discrete RF field frequency and amplitude are illustrated in FIG. 7, any appropriate RF field characteristics, including but not limited to, frequency and amplitude can be used. In addition, any of one or more of the RF field characteristics can be varied in any appropriate manner including, but not limited to, continuous and discrete variations.

In some embodiments of encoding ions, the method can include the step of determining or selecting a first frequency. Then an RF field having the selected frequency can be applied to an ion optical element. The ions can then be transmitted into an ion containment field. The ions can then be detected by a detector such as detector 34 and the frequency of the ion kinetic energy profile can be determined.

In some embodiments, multiple frequencies can be selected at different times and the frequency of the ion kinetic energy profile can be determined once detected. In various embodiments, identifying the frequency can be used to identify the particular group of ions that are detected. For example, different groups of ions can be transmitted through the ion optical element with RF fields having different frequencies applied to it.

In some embodiments, the Applicants have observed that the higher the pressure in which the optical element is situated, the larger the amplitude of the RF voltage required to achieve the same result. Specifically, in some embodiments, if all other variables are held constant and the pressure is increased, then in order to maintain a given level of fragmentation or declustering, the amplitude of the RF field applied to the ion optical element is increased.

The above discussion illustrated examples of various embodiments of the method that are carried out through the application of a RF field to an interquad lens. However, as mentioned above, the method can be implemented with any appropriate ion optical element including but not limited to curtain plate 14, the orifice plate 16, or IQ0. Accordingly, the method can be applied to virtually any ion optical element that is anywhere in the stream of ions, including at the front end of the mass spectrometer near the ion inlet.

Figure 8A:
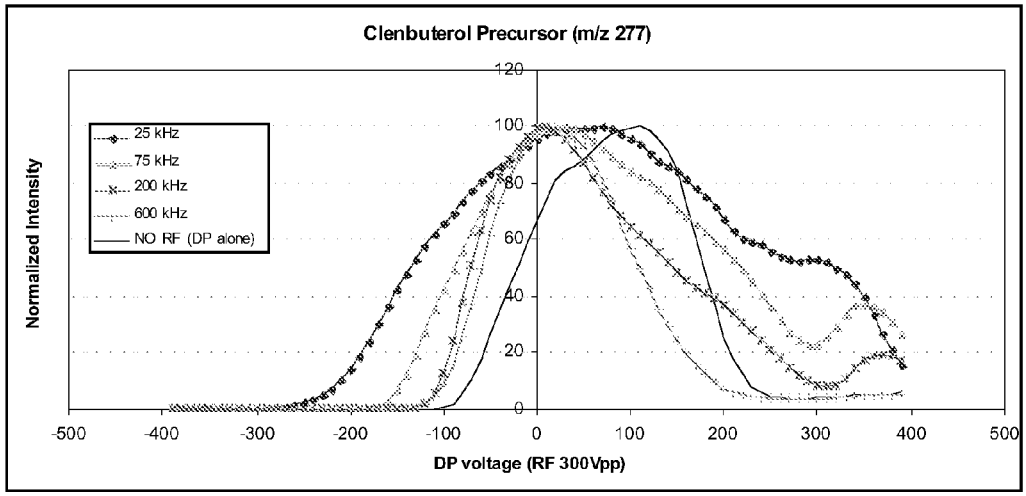
FIGS. 8A and 8B are graphs illustrating normalized intensities of a precursor ion signal and a fragment ion signal, respectively, for various RF fields applied to an ion optical element.
Figure 8B:
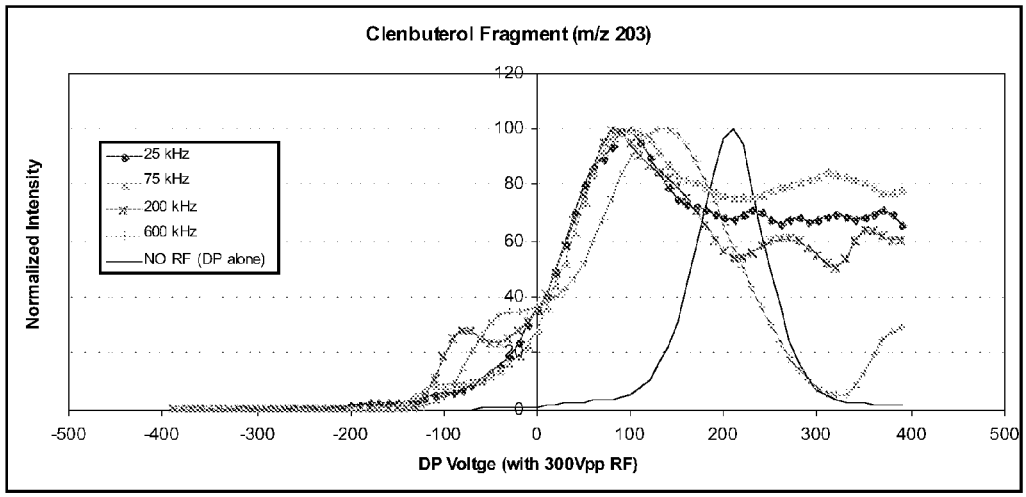

The following data was obtained using a 4000 QTRAP instrument. The precursor ions were passed through orifice plate 16 located in front of Q0. A RF field is applied to orifice plate 16. A collision gas is introduced into chamber 24 such that Q0 can be used for declustering the precursor ions. After declustering, the ions were passed through the rest of the 4000 QTRAP instrument and finally into the Q3 linear ion trap. After an appropriate cooling time, the contents of the linear ion trap were scanned out using mass selective axial ejection toward the ion detector. Reference is now made to FIGS. 8A and 8B, which are graphs illustrating the normalized intensities of precursor ion signals and fragment ion signals respectively.

More specifically, FIG. 8A illustrates the normalized intensity of the clenbuterol precursor ion (m/z 277), for various frequencies of RF field applied to orifice plate 16, against the declustering potential (DP). All the RF fields have a peak-to-peak amplitude of 300 V (or 300 Vpp). The DP voltage is a DC potential difference between the orifice plate 16 and skimmer plate 20. In various embodiments, skimmer plate 20 is grounded.

Also illustrated in FIG. 8A is the plot of the normalized intensity of the clenbuterol precursor ion for the case where no RF field is applied to the orifice plate 16. As can be see from FIG. 8A, when no RF field is applied, the intensity of the precursor ion is maximized at a DP voltage of approximately 110 V.

As can be seen from FIG. 8A, the application of a RF field to orifice plate 16 causes the maximum intensity of the ion signal to occur at a lower voltage as compared to the case where no RF field is applied to orifice plate 16. The Applicants postulate that this indicates that the presence of the auxiliary RF field is also a method for adding kinetic energy to the ions as they pass through the orifice plate.

Reference is now made to FIG. 8B, which illustrates normalized intensity of a clenbuterol fragment ion, for various frequencies of RF field applied to orifice plate, against the declustering potential (DP). All the RF fields have peak-to-peak amplitudes of 300 V (or 300 Vpp).

Also illustrated in FIG. 8B is the plot of normalized intensity of the clenbuterol fragment ion (m/z 203) for the case where no RF field is applied to orifice plate 16. As can be see from FIG. 8B, when no RF field is applied, the intensity of the precursor ion is maximized at a DP voltage above 200 V. As can be seen, the intensity of the fragment ion signal maximizes at a DP value that is higher than the maximum of the precursor ion. This is in part due to the fact that the fragment signal originates from the fragmentation of the precursor ion, which requires a higher energy than declustering.

In addition, as was the case with the precursor ion, the application of an RF field to orifice plate 16 causes the maximum intensity of the fragment ion signal to occur at a lower voltage as compared to the case where no RF field is applied to orifice plate 16. As stated above, the Applicants postulate that this indicates that the presence of the auxiliary RF field is also a method for adding kinetic energy to the ions as they pass through the orifice plate contributing to the fragmentation process.

Figure 9A:
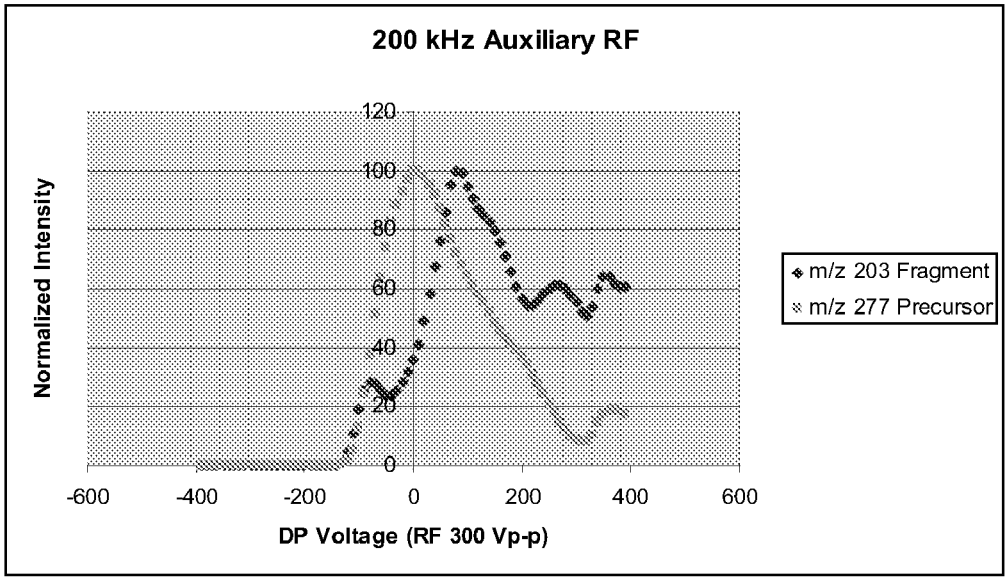
FIGS. 9A and 9B are graphs illustrating normalized intensities of a precursor ion signal and a fragment ion signal with and without, respectively, the application of an RF field to an ion optical element.
Figure 9B:
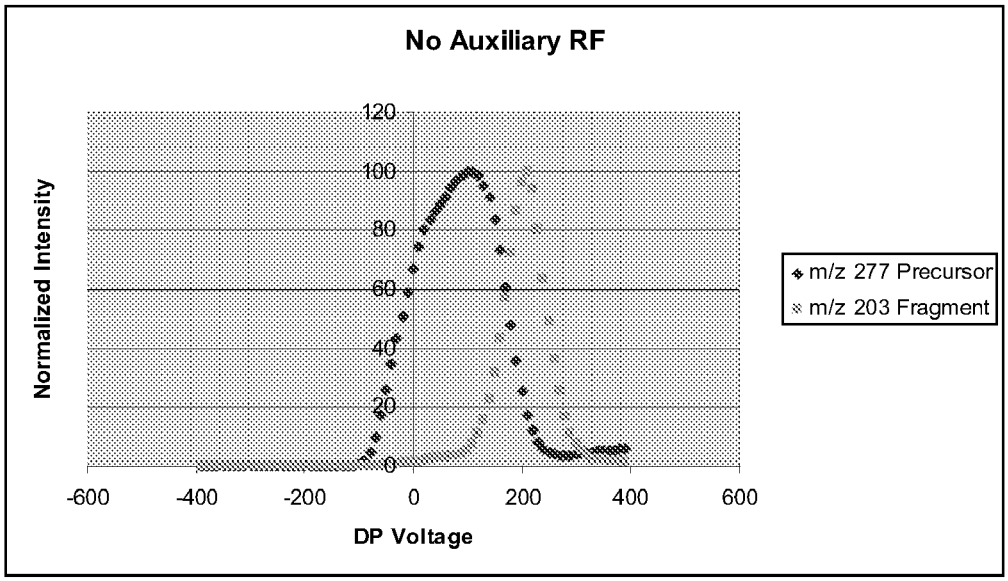

Reference is now made to FIGS. 9A and 9B which illustrate normalized intensities of a precursor ion signal and a fragment ion signal for the case where a 200 kHz Auxiliary RF field is applied to orifice plate 16 and the case where no auxiliary RF field is applied to orifice plate 16 against the DP voltage. Specifically, FIG. 9A illustrates the clenbuterol precursor ion and clenbuterol fragment ion signals for the case where a 200 kHz auxiliary RF signal is applied to orifice plate 16. FIG. 9B illustrates clenbuterol precursor ion and clenbuterol fragment ion signals for the case where no RF field is applied to orifice plate 16. As can be seen from comparing FIGS. 9A and 9B, when an auxiliary RF is present on the orifice plate, there is a much better overlap between the DP curves for the precursor and fragment ions. Specifically, in FIG. 9A, there is a range of DP voltage values where both the fragment ion intensity and the precursor ion intensity are both relatively high and near their respective maxima. In contrast, in FIG. 9B, the overlap occurs at a lower intensities and the range of overlap is smaller. The use of the method as described herein, which for example creates a condition similar to that illustrated in FIG. 9A, allows the instrument to operate under orifice voltage conditions that generate mass spectra containing significant contributions of both precursor ions and fragment ions.

While the above description provides example embodiments, it will be appreciated that the present invention is susceptible to modification and change without departing from the fair meaning and scope of the accompanying claims. Accordingly, what has been described is merely illustrative of the application of aspects of embodiments of the invention and numerous modifications and variations of the present invention are possible in light of the above teachings.

The invention claimed is:

1. A method of fragmenting ions, the method comprising:

a) providing a selected RF field to an ion optical element upstream of an ion containment field;

b) transmitting ions through the ion optical element and into the ion containment field such that the selected RF field determines, at least in part, a selected kinetic energy profile of the ions within the ion containment field, the selected kinetic energy profile of the ions comprising a plurality of kinetic energy levels, wherein the selected kinetic energy profile is selected to fragment the ions to concurrently provide a plurality of groups of product ions; and, c) detecting each group of product ions in the plurality of groups of product ions.

2. The method of fragmenting ions as defined in claim 1 wherein the plurality of kinetic energy levels for the ions includes a highest kinetic energy level and a lowest kinetic energy level, the highest kinetic energy level being at least three times the lowest kinetic energy level; and, each group of product ions in the plurality of groups of product ions comprises only ions of the same mass to charge ratio and is generated by a precursor kinetic energy level in the plurality of kinetic energy levels.

3. The method of fragmenting ions as defined in claim 2 wherein the plurality of kinetic energy levels comprises at least three kinetic energy levels, and the plurality of groups of product ions includes at least four groups of product ions.

4. The method of fragmenting ions as defined in claim 3 wherein each group of ions comprises fewer than half the ions in the plurality of groups of ions detected in c).

5. The method of fragmenting ions as defined in claim 2 wherein the highest kinetic energy level exceeds 50 eV.

6. The method of fragmenting ions as defined in claim 2 wherein the highest kinetic energy level exceeds 100 eV.

7. The method of fragmenting ions as defined in claim 1 further comprising, after c), selecting a second selected RF field, then transmitting the ions through the ion optical element and into the ion containment field such that the second selected RF field determines, at least in part, a second selected kinetic energy profile of the ions within the ion containment field; fragmenting the ions to concurrently provide a second plurality of groups of product ions; and, detecting each group of product ions in the second plurality of groups of product ions; wherein the second selected RF field is different from the selected RF field, the second selected kinetic energy profile is different from the selected kinetic energy profile, and second plurality of groups of product ions is different from the plurality of groups of product ions.

8. The method of fragmenting ions as defined in claim 1 wherein the ion optical element comprises an aperture lens.

9. The method of fragmenting ions as defined in claim 1 wherein the ion optical element comprises an element selected from the group consisting of: an interquad lens, a two wire element mounted transverse to the ion flow, a conical orifice, a skimmer plate, and a flat plate orifice.

10. The method of fragmenting ions as defined in claim 1 further comprising providing a force to at least a portion of ions upstream of the ion optical element wherein the force is substantially directed towards the ion optical element.

11. The method of fragmenting ions as defined in claim 1 further comprising providing a force to at least a portion of ions upstream of the ion optical element wherein the force is substantially directed away from the ion optical element.

12. The method of fragmenting ions as defined in claim 1 wherein the selected kinetic energy profile comprises a continuous band of kinetic energies.

13. The method of fragmenting ions as defined in claim 1 further comprising:

providing an ion source for producing the ions from neutrals; and providing a continuous path for the ions between the ion source and the ion containment field.

14. A method of declustering ions, the method comprising:

a) providing a selected RF field to an ion optical element upstream of an ion containment field; and b) transmitting analyte ions and solvent ions through the ion optical element and into the ion containment field, wherein the solvent ions are non-covalently bonded to the analyte ions, such that the selected RF field determines, at least in part, a selected kinetic energy profile of the analyte ions and the solvent ions within the ion containment field, the selected kinetic energy profile of the ions comprising a plurality of kinetic energy levels;

wherein the selected kinetic energy profile is selected to decluster most of the analyte ions and the solvent ions by breaking non-covalent bonds between the analyte ions and the solvent ions without breaking covalent bonds within most of the analyte ions to fragment the analyte ions.

15. The method of declustering ions as defined in claim 14 wherein the ion optical element comprises an element selected from the group consisting of: an interquad lens, a two wire element mounted transverse to the ion flow, a conical orifice, a skimmer plate, and a flat plate orifice.

16. The method of declustering ions as defined in claim 15 wherein a DC voltage is applied to the ion optical element.

17. A method of encoding frequency information into ions, the method comprising:

a) determining a first selected frequency;

b) providing a first selected RF field of the selected frequency to an ion optical element upstream of an ion containment field;

c) transmitting a first group of ions through the ion optical element and into the ion containment field such that a selected kinetic energy profile of the ions within the ion containment field has the selected frequency; and d) measuring a frequency of ions within the ion containment field to determine if the frequency measured is the selected frequency.

18. The method of encoding frequency information into ions as defined in claim 17 further comprising:

a) determining a second selected frequency;

b) providing a second selected RF field of the second selected frequency upstream of the ion containment field;

c) transmitting a second group of ions through the second selected RF field and into the ion containment field such that the first group of ions and second group of ions are contained together within the ion containment field, and the second group of ions within the ion containment field has a second selected kinetic energy profile of the second selected frequency; and d) measuring a frequency of a kinetic energy profile of each ion in a plurality of ions within the ion containment field, to determine whether the frequency is the first frequency or the second frequency to determine whether each ion in the plurality of ions is in the first group or the second group of ions.

* * * * *